US008347838B2

(12) United States Patent
Meintschel et al.

(10) Patent No.: US 8,347,838 B2
(45) Date of Patent: Jan. 8, 2013

(54) INTERNAL COMBUSTION ENGINE VALVE DRIVE TRAIN SWITCHING ARRANGEMENT

(75) Inventors: Jens Meintschel, Bernsdorf (DE); Thomas Stolk, Kirchheim (DE); Alexander von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 462 days.

(21) Appl. No.: 12/658,587

(22) Filed: Feb. 8, 2010

(65) Prior Publication Data

US 2010/0180843 A1 Jul. 22, 2010

Related U.S. Application Data

(63) Continuation-in-part of application No. PCT/EP2008/006489, filed on Aug. 7, 2008.

(30) Foreign Application Priority Data

Aug. 10, 2007 (DE) ..... 10 2007 037 746

(51) Int. Cl.
*F01L 1/34* (2006.01)

(52) U.S. Cl. ..... 123/90.16; 123/90.15

(58) Field of Classification Search ..... 123/90.15, 123/90.16, 90.17
See application file for complete search history.

(56) References Cited

U.S. PATENT DOCUMENTS

2007/0034184 A1* 2/2007 Dengler ..... 123/90.17

FOREIGN PATENT DOCUMENTS

| | | |
|---|---|---|
| CN | 1245245 | 2/2000 |
| CN | 1301912 | 7/2001 |
| DE | 102 12 327 | 3/2003 |
| DE | 10 2004 056 290 | 6/2006 |
| DE | 10 2005 006 489 | 8/2006 |
| JP | 2010-535966 | 11/2010 |
| JP | 2010-535967 | 11/2010 |
| WO | WO 2005/080761 | 9/2005 |

* cited by examiner

*Primary Examiner* — Zelalem Eshete
(74) *Attorney, Agent, or Firm* — Klaus J. Bach

(57) ABSTRACT

In an internal combustion engine valve drive train switching arrangement with a switching unit, the switching unit has at least one actuating unit with at least two switching members and at least one switching device for actuating the two switching members independently in an at least partial chronological offset, so as to perform a first switching process based on a first signal and then a second switching process, independently of an electronic evaluation.

13 Claims, 18 Drawing Sheets

INTERNAL COMBUSTION ENGINE VALVE DRIVE TRAIN SWITCHING ARRANGEMENT

This is a Continuation in Part application of pending international patent application PCT/EP2008/006489 filed Aug. 7, 2008 and claiming the priority of German patent application 10 2007 037 746.2 filed Aug. 10, 2007.

BACKGROUND OF THE INVENTION

The invention relates to an internal combustion engine valve drive train switching arrangement.

DE 10 2005 006 489 A1 discloses an internal combustion engine valve drive train switching arrangement, where switching processes which are coupled to each other are carried out simultaneously.

It is the object of the present invention to provide a valve drive train switching arrangement which has a small size and a low weight as well as low costs but which nevertheless has a high operating safety.

SUMMARY OF THE INVENTION

In an internal combustion engine valve drive train switching arrangement with a switching unit, the switching unit has at least one actuating unit with at least two switching members and at least one switching device for actuating the two switching members independently in an at least partial chronological offset, so as to perform a first switching process based on a first signal and then a second switching process, independently of an electronic evaluation.

The number of the required switching devices can be reduced hereby. A "switching unit" is a unit which is provided to effect a switching process of at least one valve drive train. "Provided" means specially equipped and/or designed. An "actuation unit" is unit which carries out at least one process based on a signal and which can especially be formed of mechanical, quantum-mechanical, electrical and/or electromechanical components, and especially also of electronic components, if these do essentially not influence the process and, particularly, do not influence the process at all. A "switching device" is a device, which is provided to effect a switching process, especially also in cooperation with at least one switching means or another unit. A "switching means" is a means which is provided to effect a switching process, especially also in cooperation with at least another switching means or another unit.

In an advantageous arrangement of the invention, the actuating unit is provided to actuate the switching devices independently of each other in at least one operating mode in dependence on the positions of the switching units relative to the switching means. The number of the required switching means can thereby be further reduced. The actuating unit "actuating" a switching device is meant to refer to a cooperation and/or interaction of the actuating unit or parts of the actuating unit with the switching device, which can effect a switching process. The actuating unit actuating the switching devices "independently from each other" means that an actuation of a switching unit by the actuating unit does not influence an actuation of another switching device. An "operating mode" refers to a type of an operation.

The actuating unit can comprise an electronic evaluation unit and to carry out a first switching process based on at least one signal and thereafter a second switching process in dependence on an electronic evaluation. The actuating unit is however especially advantageously adapted to carry out a first switching process based on at least one signal and thereafter a second switching process independently of an electronic evaluation. A "signal" is a triggering event and/or a sign, as for example a current pulse, with a defined meaning and/or an acting upon and/or positioning of a mechanical component in a switching position and/or mechanical interaction from the outside of the actuating unit. A "triggering process" is a mechanical, electrical, quantum-mechanical and/or electromechanical process, which can especially lead to a certain positioning of a switching means. A "switching process" refers to a relative movement and especially an axial relative movement between two components. A switching process taking place "after" another switching process means that the switching processes take place at least partially in a chronological offset manner and/or preferably in a manner which is free of chronological overlap. An electronic "evaluation" is an electronic arrangement and/or assessment of a state and/or a signal and/or a process. An actuation "independent" of an electronic evaluation means an automated actuation in a mechanical, quantum-mechanical, electrical and/or electromechanical manner. A simple construction of the switching unit can be achieved with an arrangement according to the invention.

In a preferred embodiment of the invention, the actuating unit is formed at least partially as a mechanical unit. Construction costs can be saved hereby.

It is additionally suggested that the actuating unit is formed at least partially as a transmission. A simple construction of the actuating unit can be achieved thereby. The transmission can especially be a cam transmission. Other transmissions which appear to be sensible to the expert are furthermore also conceivable, as for example gear transmissions, lever transmissions, hydraulic transmissions etc.

The actuating unit is advantageously provided to effect a switching of a valve train and/or a change of at least one valve lift curve and/or a switch-off of at least one valve and/or at least a change of operating modi of an internal combustion engine. A simple and efficient operation of the valves of a valve train can be achieved hereby. A "valve train" is a constructional unit which is provided to permit a gas change at least partially in internal combustion engines, which are based on a piston machine. A "switching" of a valve drive train is a change-over process for changing at least one property and/or at least one function of the valve drive train and/or a change between different operating modi. A "valve lift curve" is the graph of the function which is obtained when the valve lift relative to the cylinder with which the valve is associated is measured, is plotted over the rotary angle of the drive shaft associated with the valve train in a cartesian coordinate system. "Different operating modi" is the actuation of valves with different control times and/or valve lift curves. A "change of the operating modi" here refers to the operation of the internal combustion engine with full load, with partial load, in the self-ignition operation, with cylinder switch-off, with early or late inlet closure or further operating modi which appear sensible to the expert.

It is additionally suggested that the actuating unit is provided to actuate at least one of the switching units in dependence on at least one position change relative to the switching means. The number of the required switching units and the number of the required switching means can be reduced hereby.

It is further suggested that at least two switching means of the actuating unit are associated with different switching directions. A switching process can thereby be designed in a manner which saves components. A "switching direction" is a direction, in which a component is moved relative to the switching means with a switching process effected relative to the switching means, especially in a translational manner. Superposed movements, such as translational and rotating movements are also conceivable in principle.

The switching means advantageously corresponds to the switching units and the switching units are at least partially decoupled in their movement. The switching units can thereby be moved in different directions relative to the switching means. A switching unit can especially rest relative to the switching means, while another switching unit moves relative to the switching means. A switching unit "corresponding" to a switching means is a switching unit, which is formed in such a manner that it enables a switching process in cooperation with the switching means. At least partially "decoupled" switching units in their movement refers to switching units for which at least one movement of a switching unit relative to the other switching unit is independent therefrom in at least one operating mode.

It is further suggested that the actuating unit is provided to actuate the switching units simultaneously in at least one operating mode. Hereby, it can be achieved in a constructively simple manner that a switching means can actuate two switching units at least in a partially decoupled manner.

in a preferred embodiment of the invention, the actuating unit has at least two control means which are positioned at ends facing each other of the at least two switching units of the actuating unit. The extension of the individual control means can thereby be reduced. A "control means" is a means for controlling a process, especially for controlling a switching process. The switching units can be associated with different valves, which can be associated with different cylinders. The switching units can be associated with only one valve for a particularly flexible switching.

The control means reside preferably in at least one control track. A switching device for switching processes between the switching units and the switching means can thereby be realized in a simple manner. A "control track" is at least a passage or several passages together with edges or side walls, which are provided to guide a switching means during at least one switching process, and which extend individually or together over a defined angular region, as preferred over more than 10°, preferably over more than 80°, and especially preferred over more than 180° in the circumferential direction of a drive shaft or a component connected to a drive shaft, wherein the passages can be separated spatially from each other and this spatial separation can be cancelled by a switching process. A "clearance" is especially meant to be an elevation or a recess, which can have different forms which appear sensible to the expert, as especially an elongated extension form. A passage can especially be a slot or a groove. A "slot" is especially a small recess. An "elevation" is an elevated area compared to the area surrounding the location and/or a bulge or a wall section.

In a preferred arrangement of the invention, the actuating unit has at least one control track which is formed by at least two of the switching units. A switching device for switching processes can thereby be realized in an especially simple manner, with which the switching units participate.

The control track is preferably formed in such a manner that the switching units can be actuated by the switching means in a defined switching sequence. The control tracks can thereby be used in a continuous operation. A "defined switching sequence" refers to switching processes which take place according to a predetermined course and which are at least partially chronologically offset and/or separate switching processes, which are especially also suitable for a continuous operation with at least two occurring defined switching sequences.

It is further suggested that the actuating unit has at least one control track, which is provided to effect a switching of a valve train by an interaction with the switching means. A reliable change of valve lift curves can be achieved hereby.

The switching unit preferably has at least one switching means, wherein the control means is provided to change at least one function of the switching unit and/or of the switching means based on an interaction with the switching means. A compact switching design can be achieved hereby. A "function" is a mode of operation and especially a mode of operation during an interaction with another constructional unit, which can for example be the switching means or the switching unit.

In this connection, an advantage can be achieved if the function is a plunging of the switching means into the switching unit and/or a removal of the switching means from the switching unit and/or an actuation of the switching unit by the switching means and/or a change of the switching means from one switching unit to another switching unit and/or a resting of the movement of a switching unit. An effective mechanical switching device can be realized thereby. A "plunging" of the switching means into the switching unit is an introduction of the switching means in the form of an elevation or a pin into a groove or a slot of a switching unit. A "removal" of the switching means from the switching unit means the retraction of the switching means in the form of a pin from the groove or the slot of the switching unit. A "resting" of the movement of a switching unit refers to a resting position of the switching unit relative to the switching means after a movement of the switching unit relative to the switching means.

The actuating unit preferably comprises at least one control track, which is provided to be acted upon by the switching means in at least one radial direction. A constructively simple interaction between the switching means and the control track can be achieved thereby. A "radial direction" is a radial direction in relation to a drive shaft. An "acting upon" the control track by the switching means means that the switching means impinge on a wall of a control track during a movement.

It is additionally suggested that the actuating unit includes a camshaft and, at least to a large part, the switching units through which valve lift curves of valves associated with the camshaft can be changed, and that the switching units are provided to be actuated by the switching means. A coherent switching can be achieved hereby and a faulty switching of individual cams can thereby be prevented. A "large part" are especially meant to be at least 50 percent, especially at least seventy percent, and especially advantageously at least ninety percent of the total number. A valve shall especially be "associated" with a camshaft, when the valve is opened and/or closed directly or indirectly by means of the camshaft.

The switching means is preferably formed as a switching pin. A cost-effective arrangement of the switching means is thereby possible.

The switching unit and at least one switching means are advantageously provided to cause an axial displacement of the switching unit relative to the switching means by an interaction with each other, and thereby effect a switching of a valve drive train. The valve train can hereby be switched in a constructively simple manner. An "axial" displacement of the switching unit is a displacement of the switching unit in a main extension direction of a drive shaft, specifically a camshaft.

It is further suggested that the switching unit is formed as an axially displaceable part of a camshaft with cams having at least partially different contours. In this manner, the switching unit can directly carry out a switching process at a cam. A "cam" is a cam-like projection on a shaft rotating in an operating mode, which can be formed as a camshaft. An "at least partially differently formed contour" is a different extension of the projections of different cams and/or of a cam.

The invention will become more readily apparent from the following description of preferred embodiments thereof with reference to the accompanying drawings.

BRIEF DESCRIPTION OF THE DRAWINGS

It is shown in.

DESCRIPTION OF A PARTICULAR EMBODIMENT OF THE INVENTION

Figure 1:
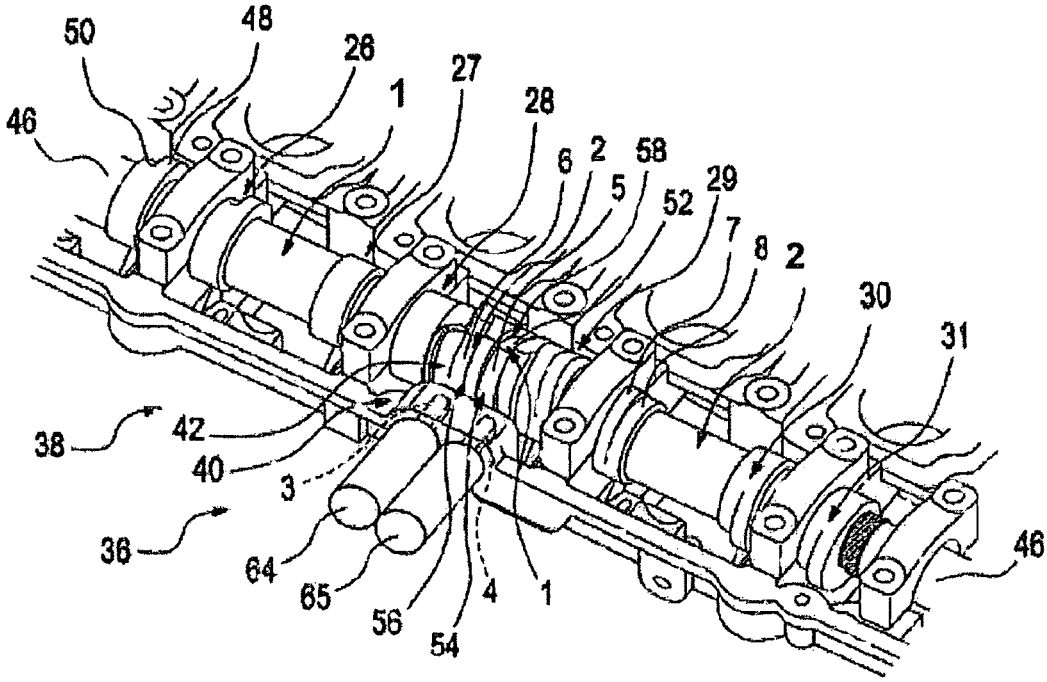
FIG. 1 parts of an internal combustion engine valve train switching arrangement with a switching unit, FIG. 2 a development of a control track, FIG. 3 a top view of developments of two control tracks, FIGS. 4*a* and 4*b*. an intermediate state during a first step of a switching process to the right, FIGS. 5*a* and 5*b*. an intermediate state during a second step of a switching process to the right, FIGS. 6*a* and 6*b*. an intermediate state during a third step of a switching process to the right, FIGS. 7*a* and 7*b*. an intermediate state during a fourth step of a switching process to the right, FIGS. 8*a* and 8*b*. an intermediate state during a fifth step of a switching process to the right, FIGS. 9*a* and 9*b*. an intermediate state during a sixth step of a switching process to the right, FIGS. 10*a* and 10*b*. an intermediate state during a seventh step of a switching process to the right, FIGS. 11*a* and 11*b*. an intermediate state during an eighth step of a switching process to the right, FIGS. 12*a* and 12*b*. an intermediate state during a first step of a switching process to the left, FIGS. 13*a* and 13*b*. an intermediate state during a second step of a switching process to the left, FIGS. 14*a* and 14*b*. an intermediate state during a third step of a switching process to the left, FIGS. 15*a* and 15*b*. an intermediate state during a fourth step of a switching process to the left, FIGS. 16*a* and 16*b*. an intermediate state during a fifth step of a switching process to the left, FIGS. 17*a* and 17*b*. an intermediate state during a sixth step of a switching process to the left, FIGS. 18*a* and 18*b*. an intermediate state during a seventh step of a switching process to the left, FIGS. 19*a* and 19*b*. an intermediate state during an eighth step of a switching process to the left.

FIG. 1 shows an internal combustion engine valve train switching arrangement with a switching unit 36, which has two actuators 64, 65, a camshaft 46 and an actuating unit 38, which is provided to perform a first switching process based on a signal, and then a second switching process independent of an electronic evaluation. The actuating unit 38 only has mechanical components and is thus formed as a mechanical unit 40. The actuating unit 38 further comprises two switching means 3, 4 respectively formed by a switching pin 4, which can be actuated by the actuators 64, 65 or be moved out of the actuators 64, 65. The actuating unit 38 additionally comprises switching units 1, 2, which are part of the camshaft 46. The switching units 1, 2 have a common main extension direction, which coincides with a main extension direction of the camshaft 46. The switching means 3, 4 also have a common main extension direction, which extends radially to the camshaft 46 and the switching units 1, 2.

The switching means 3, 4 are respectively provided to actuate the two switching units 1,2. During the extension of a switching means 3, 4, which takes place in its main extension direction towards the switching unit 1, 2, an acting upon a switching unit 1, 2 first takes place, and then an interaction between the switching means 3, 4 and the switching units 1, 2, which is described by means of FIGS. 4*a* to 19*b*, and due to which an axial displacement of the switching units 1, 2 relative to the switching means 3, 4 along the main extension direction of the switching units 1, 2 takes place. An axial displacement of cams 7, 8, 48, 50, 26, 27, 28, 29, 30, 31 belonging to the switching unit 1, 2 takes place with the axial displacement of the switching units 1, 2. The cams 7, 8 and 48, 50 have a different contour of the type that the maximum radial extension of the cams 8, 50 is different from the maximum radial extension of the cams 48, 7. As the camshaft 46 only comprises the cams 7, 8, 48, 50, 26, 27, 28, 29, 30, 31, both switching means 3, 4 can respectively actuate the switching units 1, 2, by which valve lift curves of valves can be changed, which are associated with the camshaft 46.

The switching unit 1 has a control means 52, which is formed by sections 9, 11, 13, 16, 18 (see FIG. 3), which are formed by four grooves. The switching unit 2 further has a control means 54, which is formed by sections 10, 12, 14, 15, 17 (see FIG. 3), which are formed by four grooves. The control means 52, 54 are positioned in end regions or on ends 56, 58 of the switching units 1, 2, which face each other in the main extension direction of the camshaft 46 and are directly adjacent to each other. The control means 52, 54 form two control tracks 5, 6, which are arranged behind each other in the main extension direction of the camshaft 46. The control tracks 5, 6 are thus respectively formed by the two switching units 1, 2.

The switching means 3, 4 are arranged in such a manner that they can act upon the control tracks 5, 6 in the radial direction during a switching process. The switching means 3, 4 are arranged successively along the main extension direction of the camshaft 46 in the same sequence as the control tracks 6, 5. The switching means 3 can act upon the control track 6, and the switching means 4 can act upon the control track 5.

Figure 2:
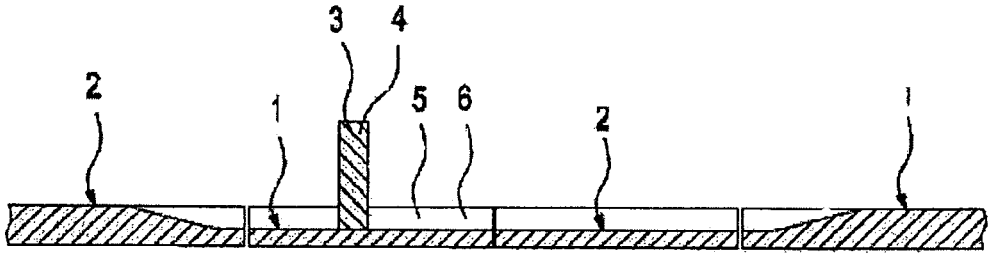

FIG. 2 shows a development of one of the control tracks 5 or 6, which extends over more than one camshaft rotation, namely over about 540°. Other angular regions which appear to be sensible to the expert are also conceivable.

According to the invention, each of the control tracks 5, 6 permits a change of the switching means 3, 4 during a switching process from one switching unit 2 to another switching unit 1 and back.

Figure 3:
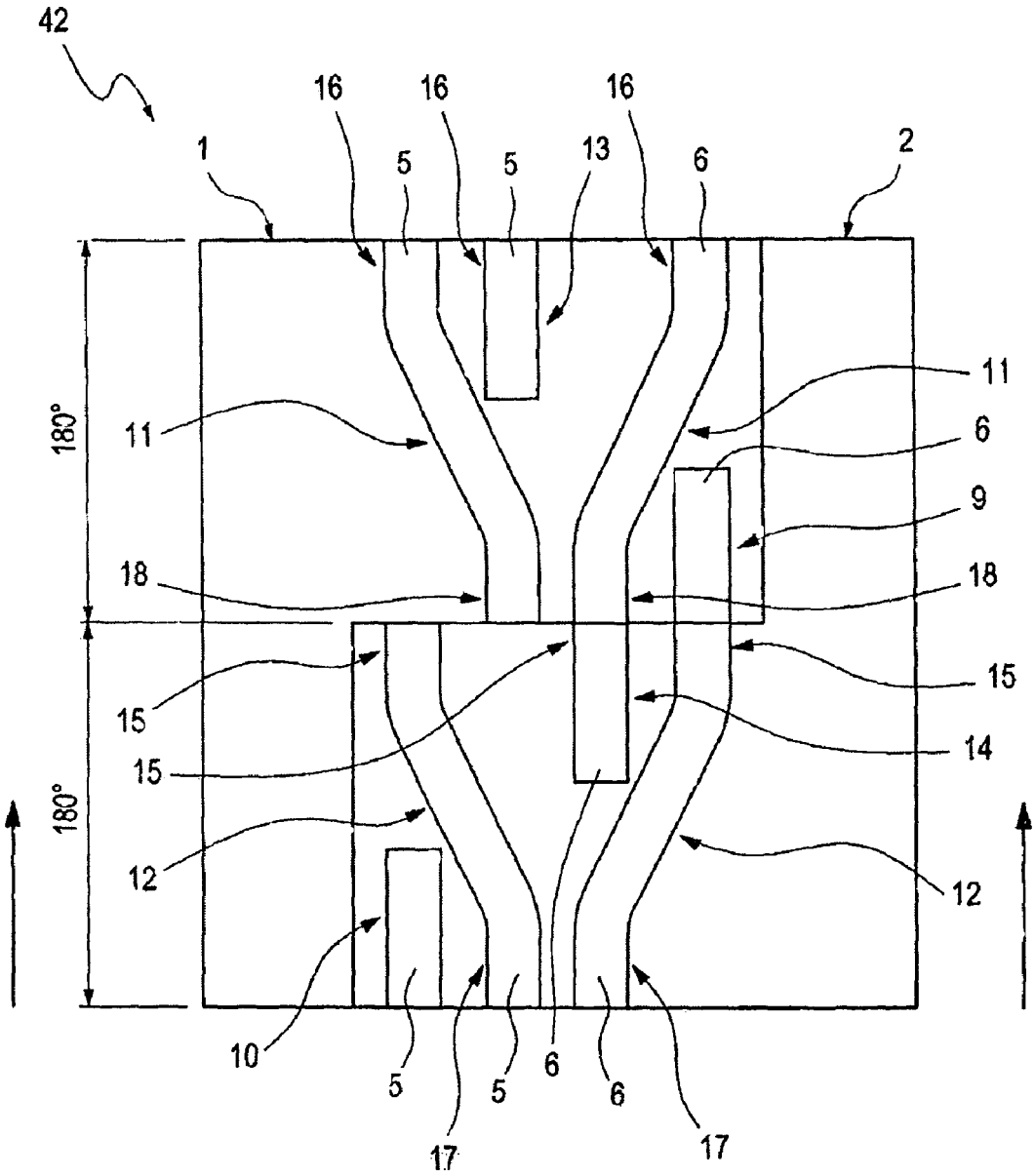
Figure 4B:
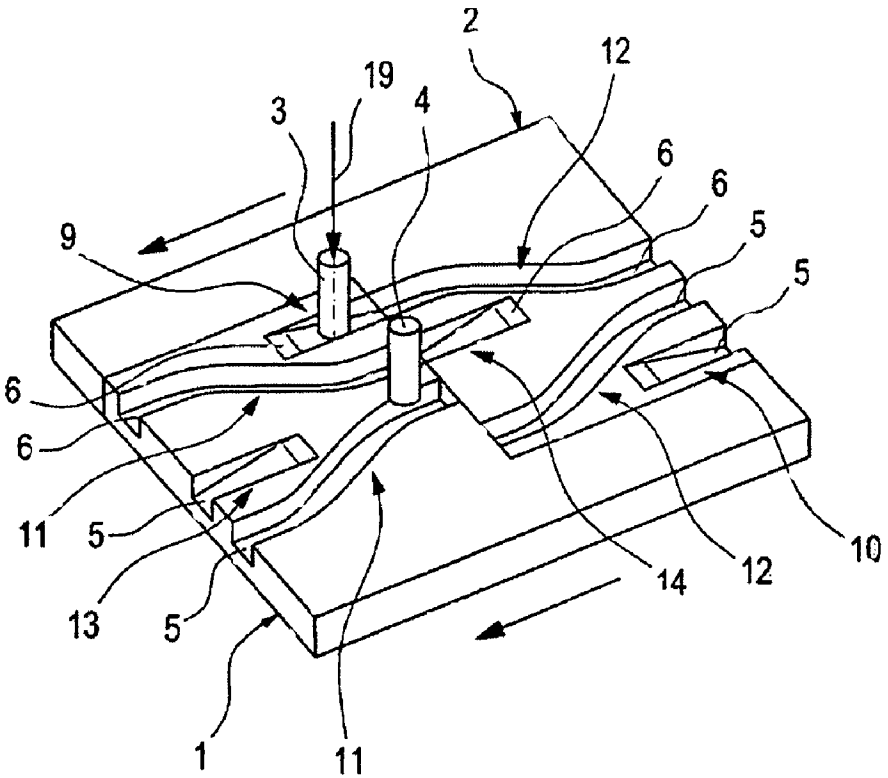
Figure 4A:
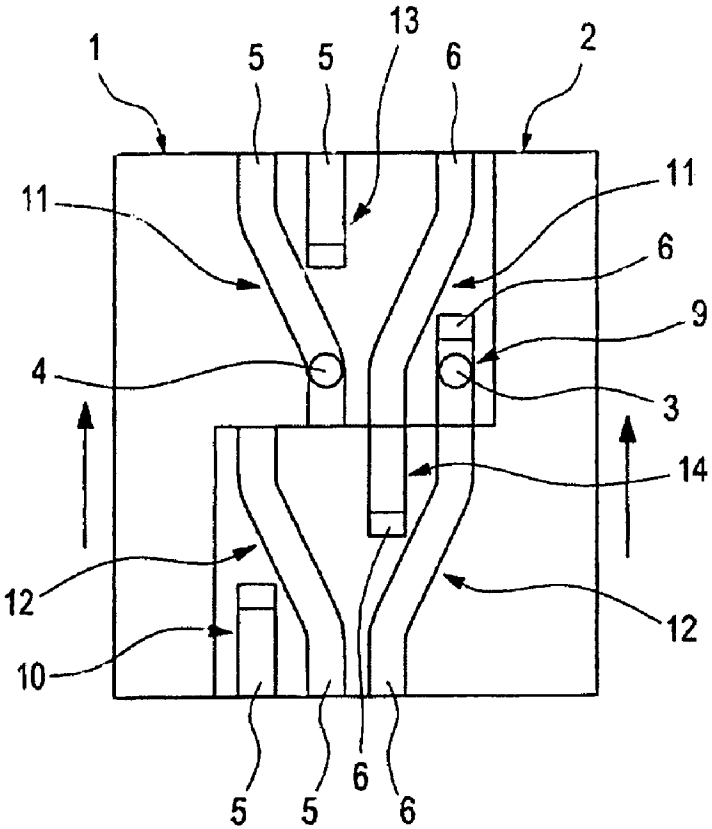
Figure 5B:
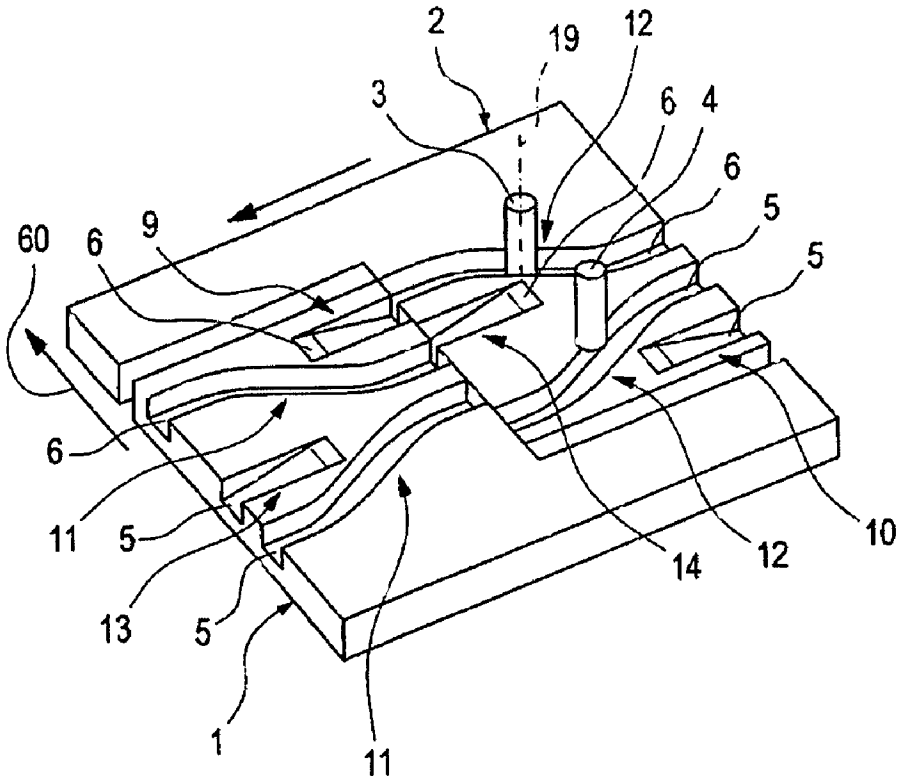
Figure 5A:
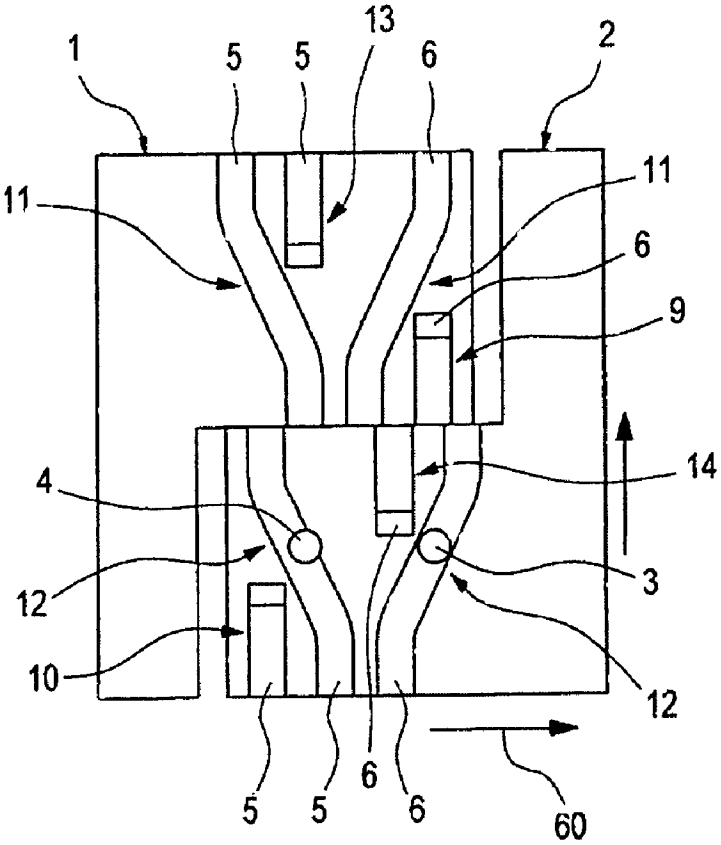
Figure 6B:
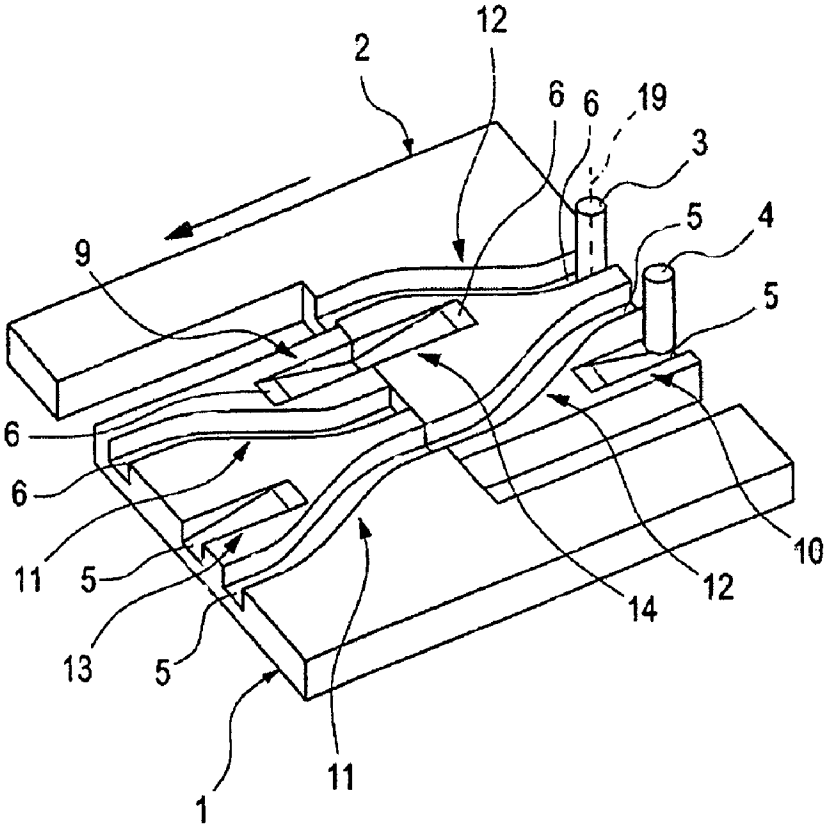
Figure 6A:
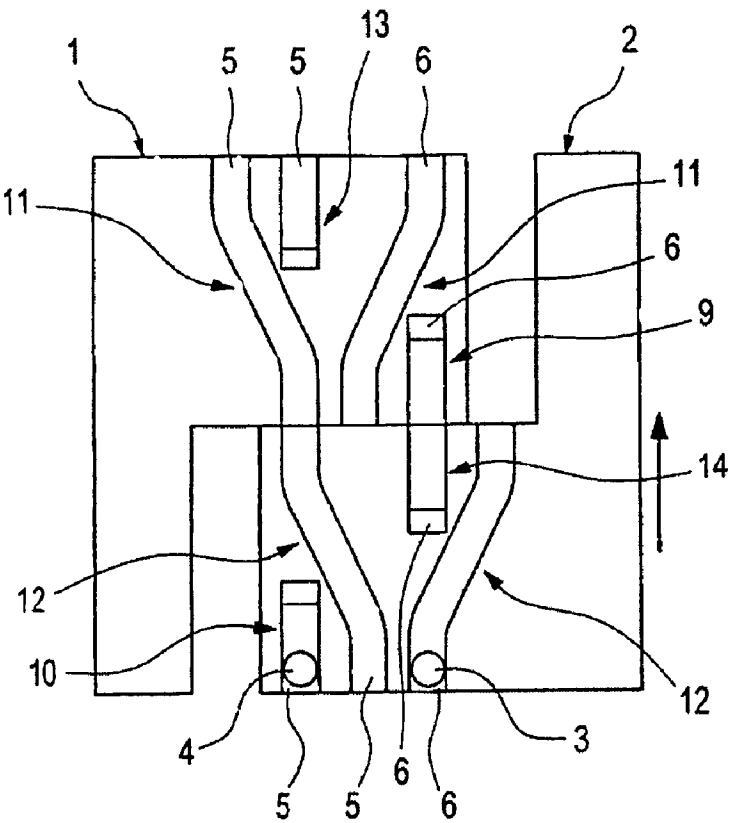
Figure 7B:
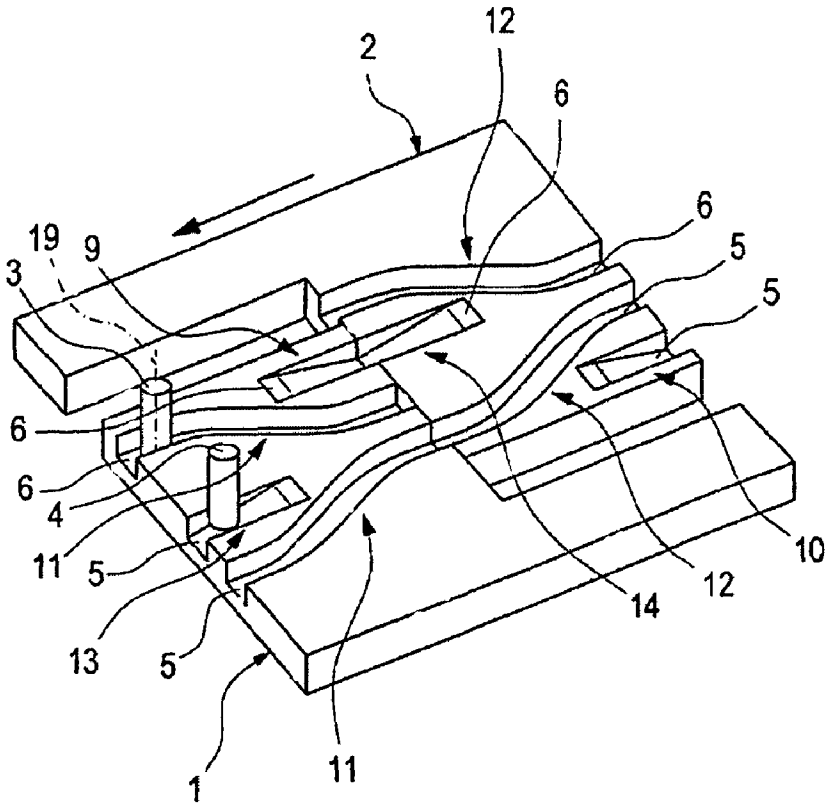
Figure 7A:
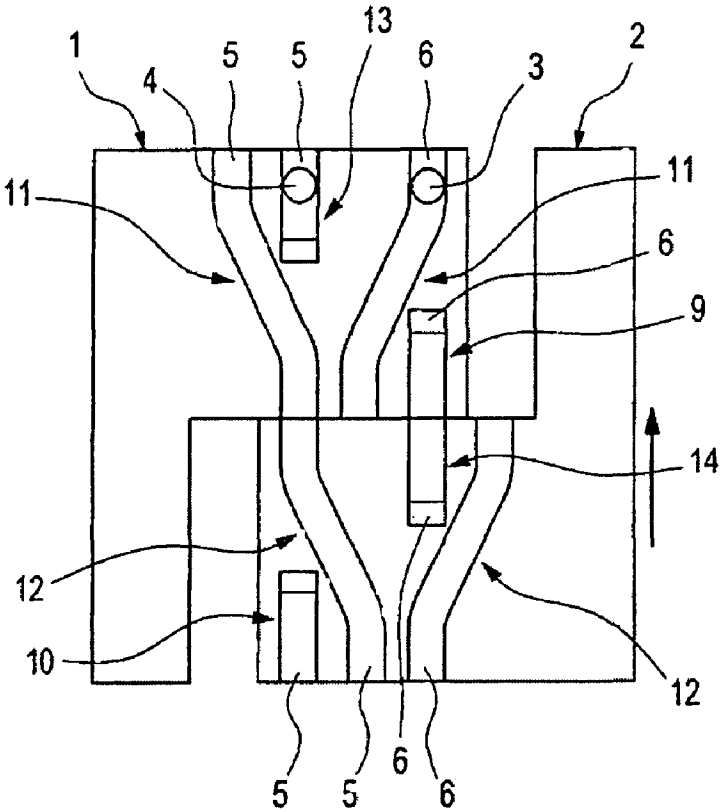
Figure 8B:
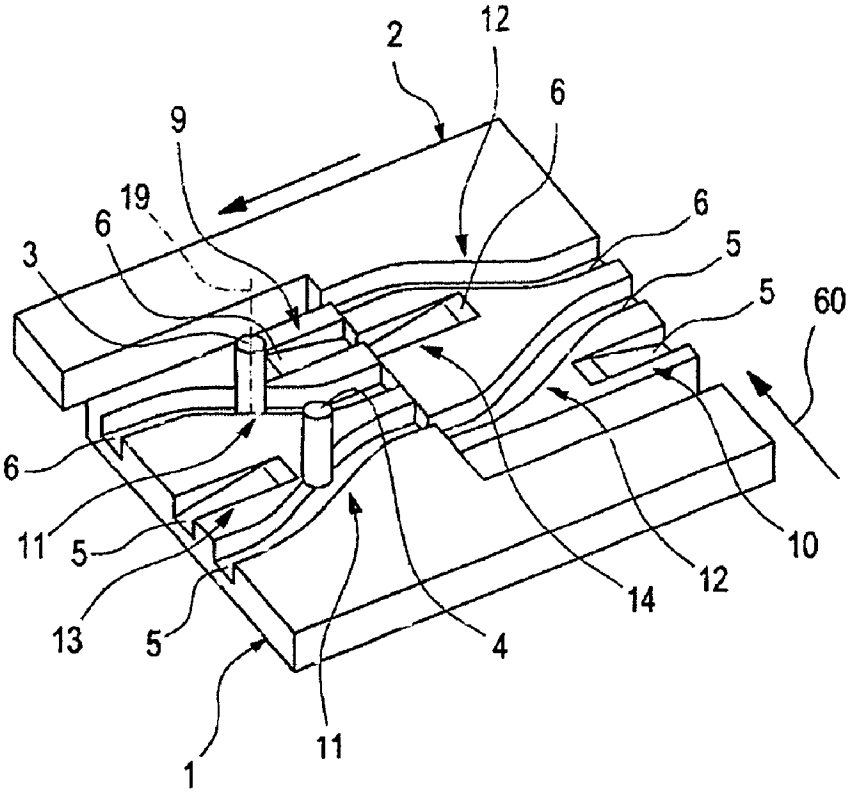
Figure 8A:
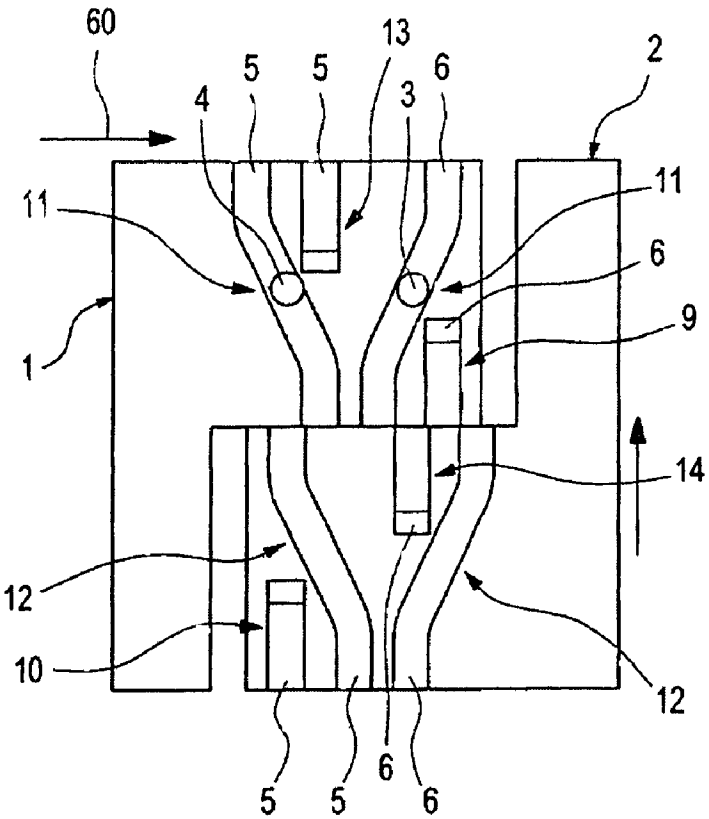
Figure 9B:
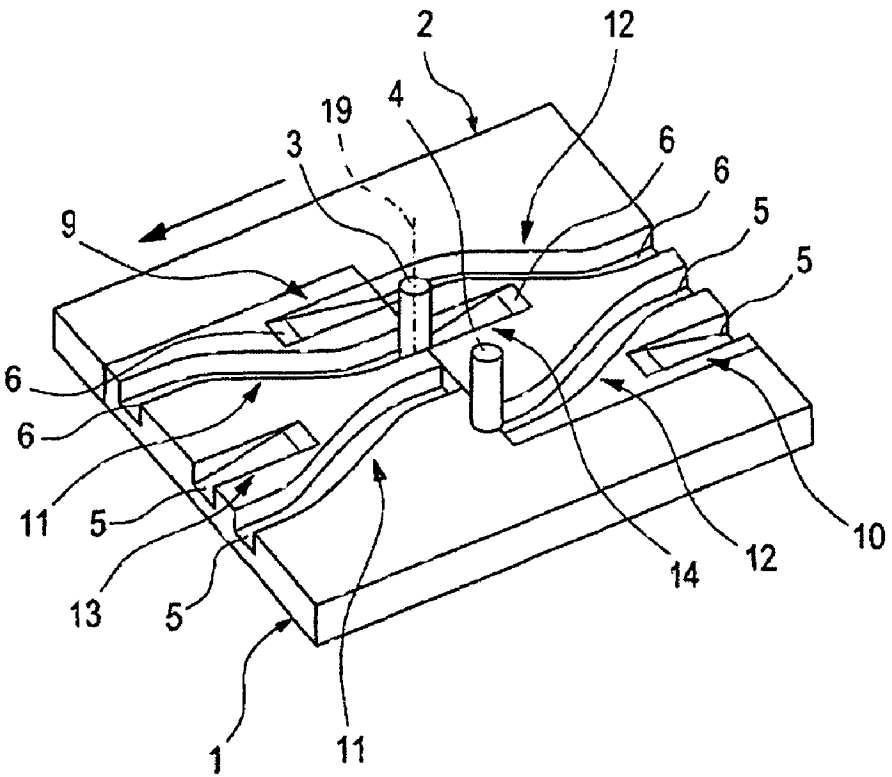
Figure 9A:
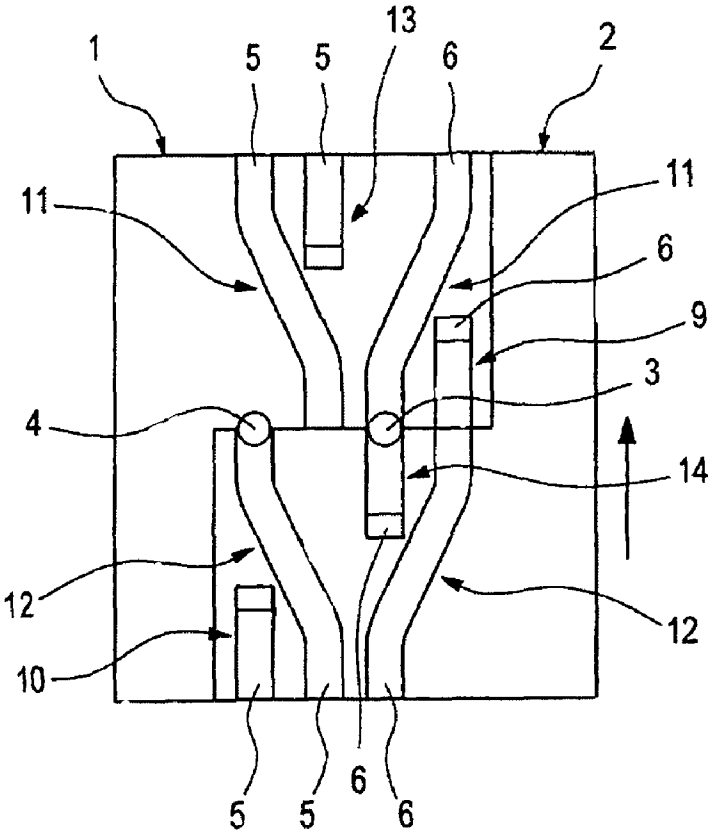
Figure 10B:
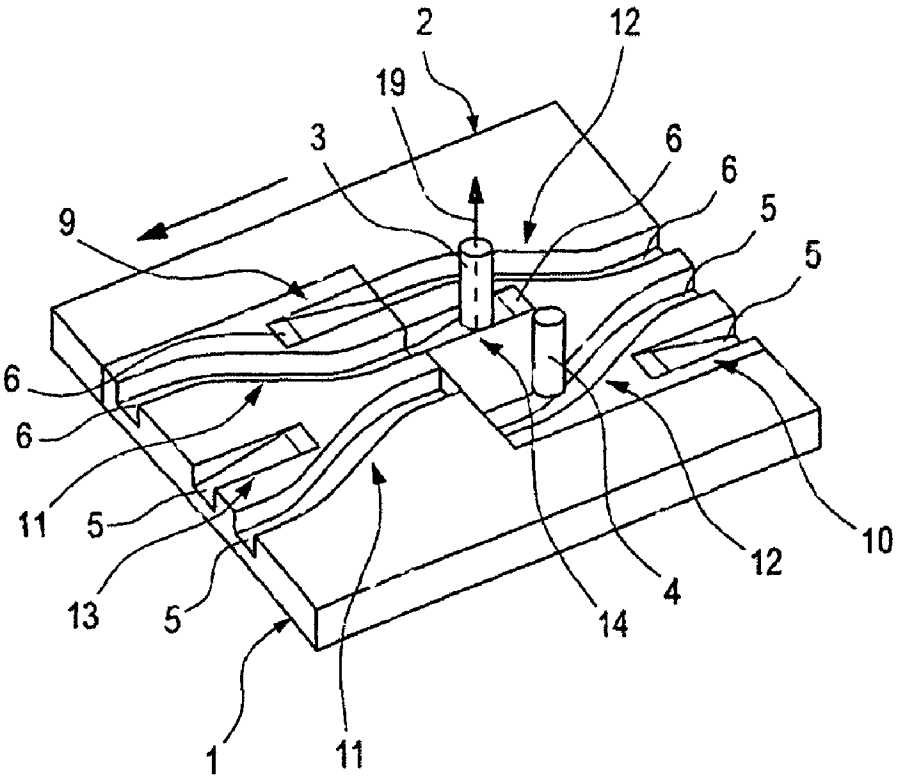
Figure 10A:
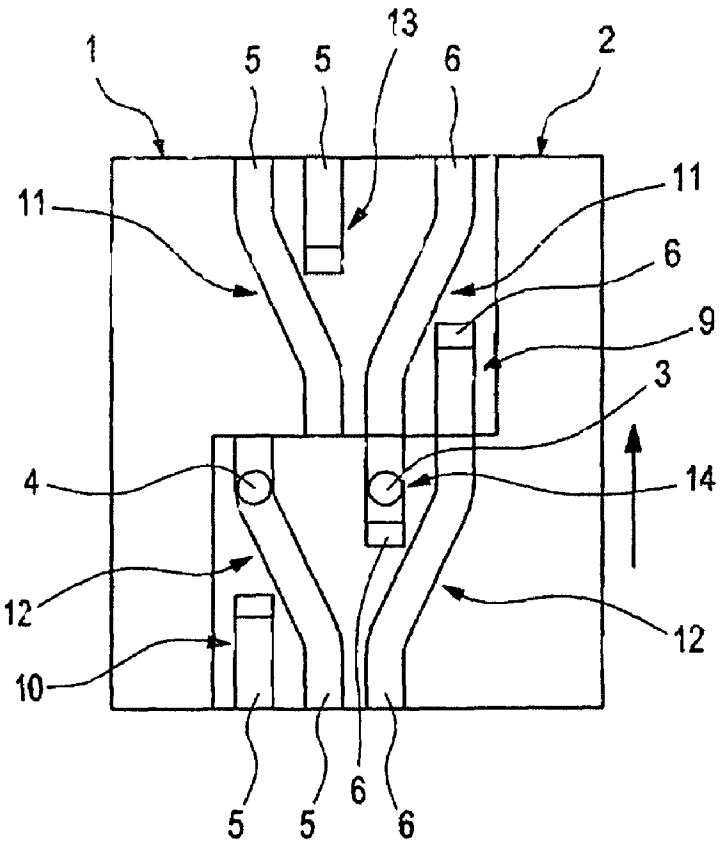
Figure 11B:
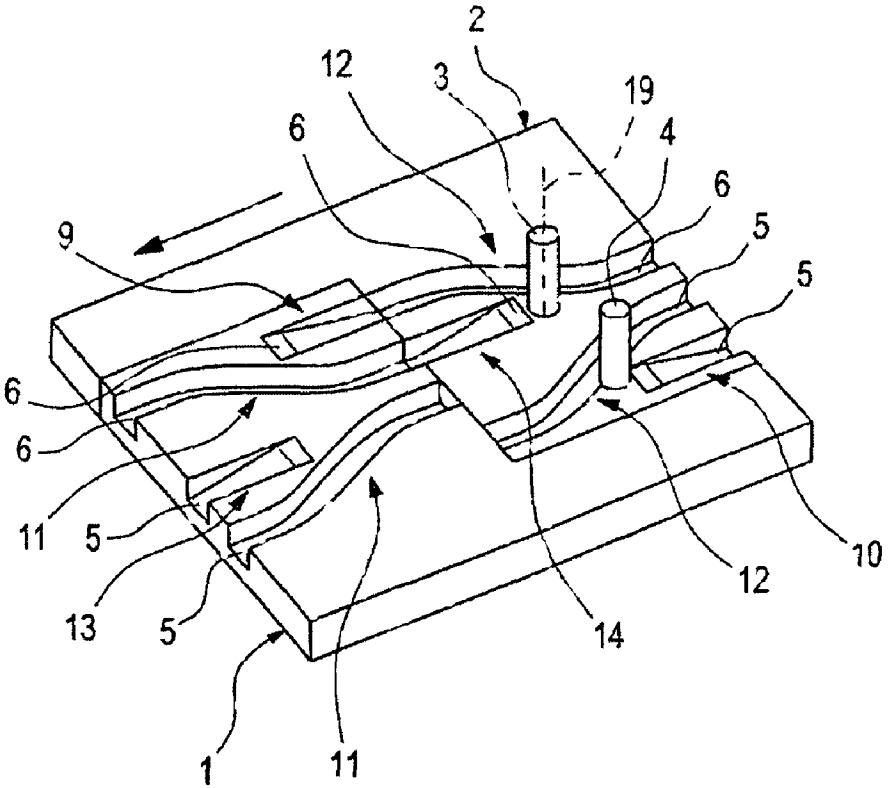
Figure 11A:
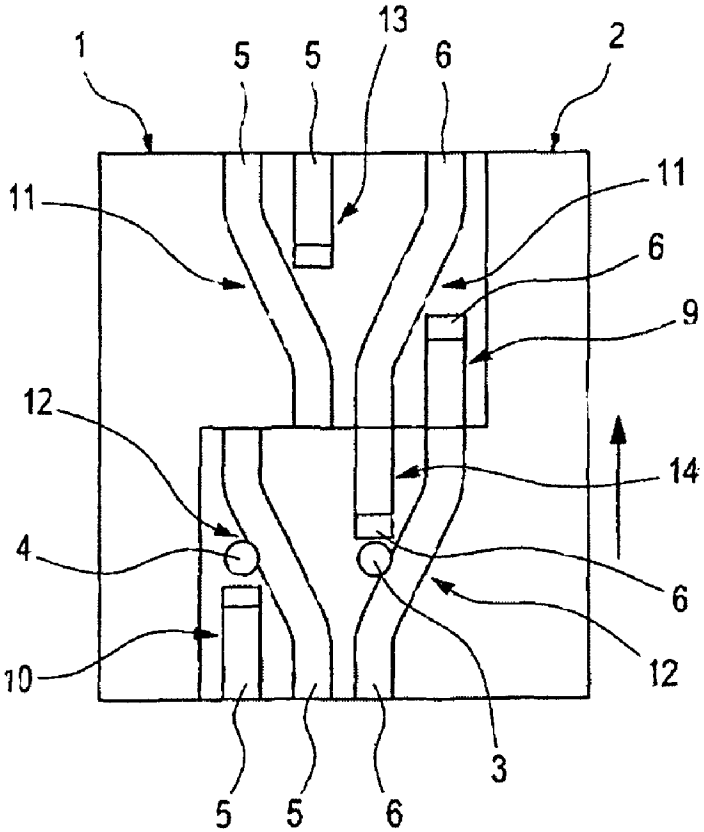
Figure 12B:
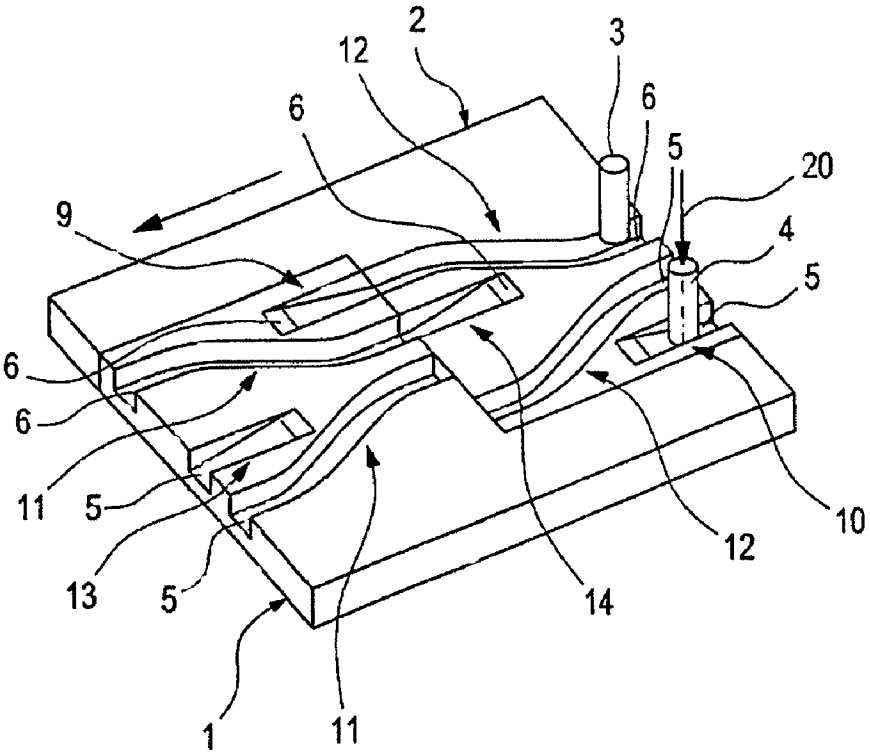
Figure 12A:
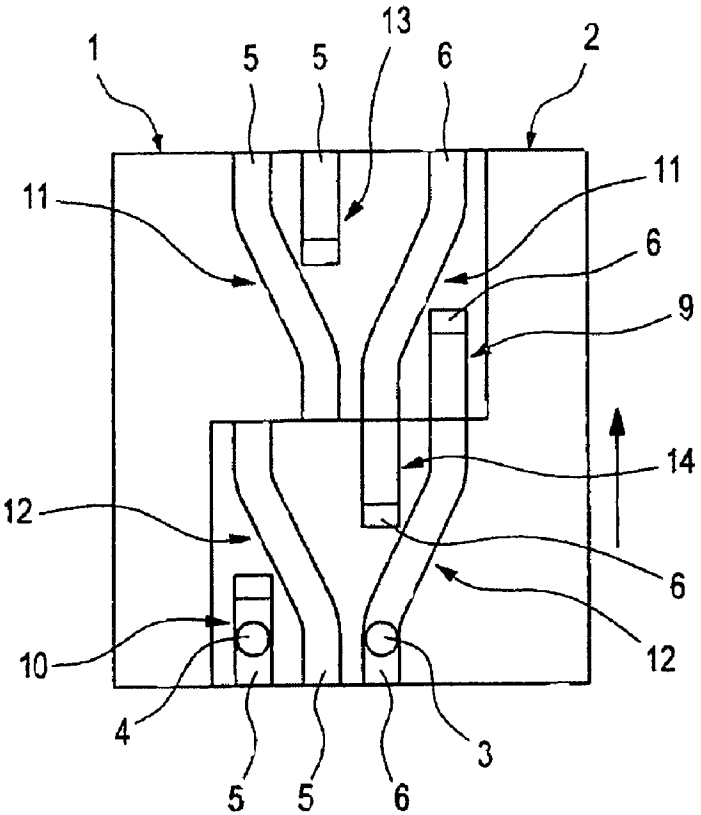
Figure 13B:
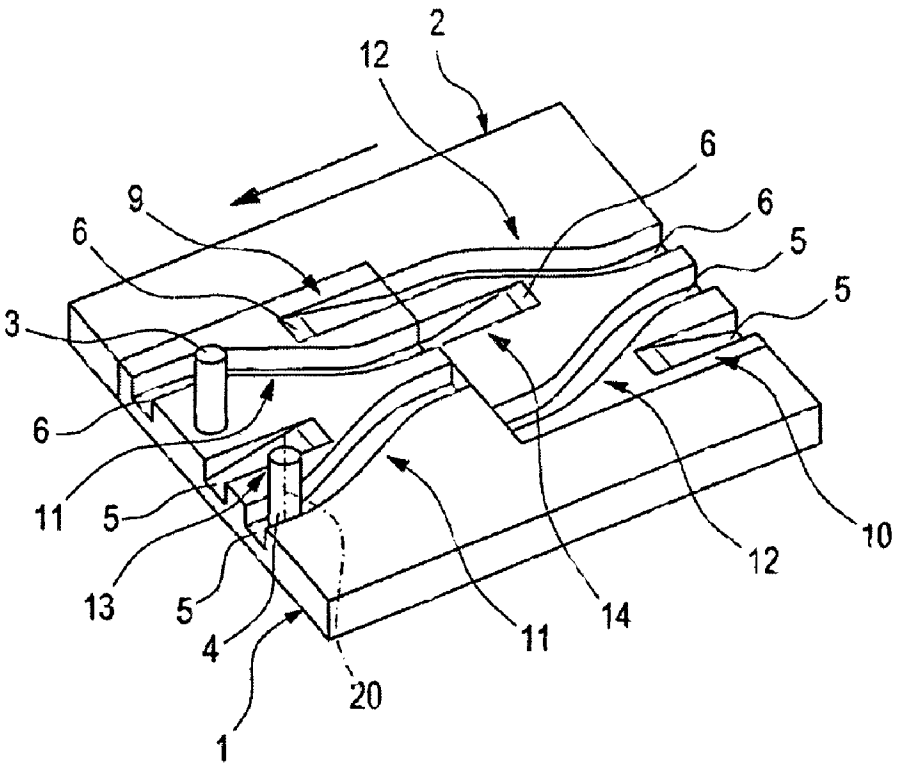
Figure 13A:
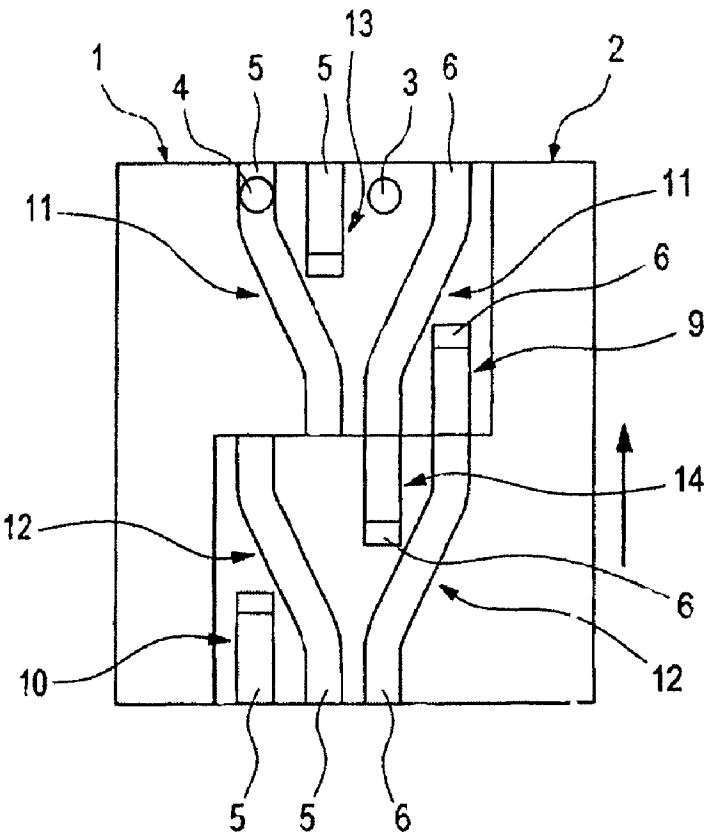
Figure 14B:
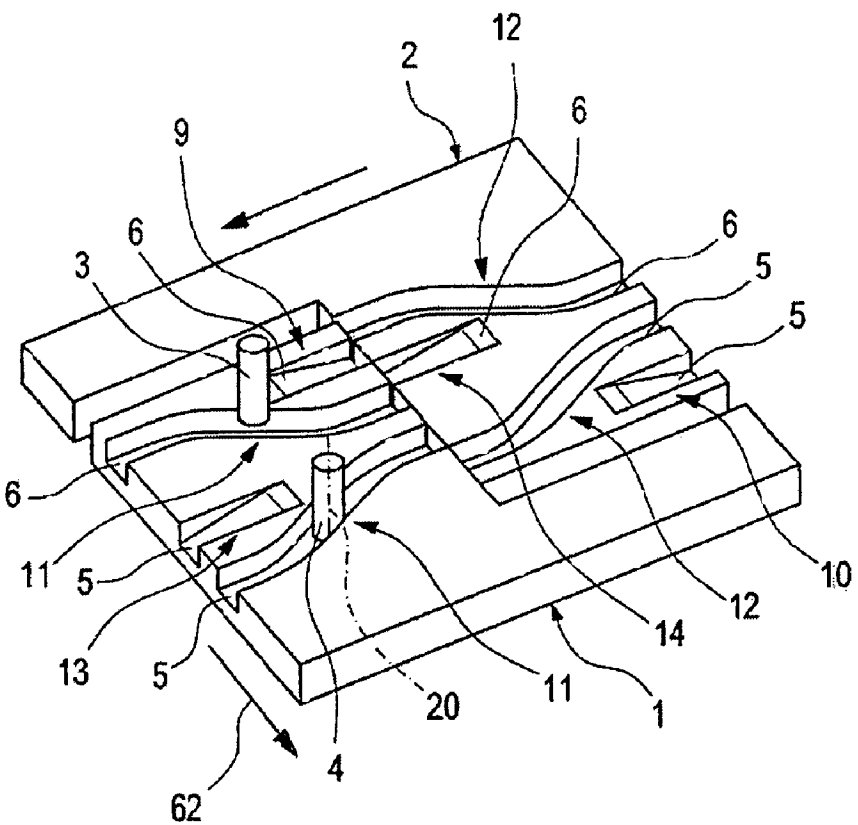
Figure 14A:
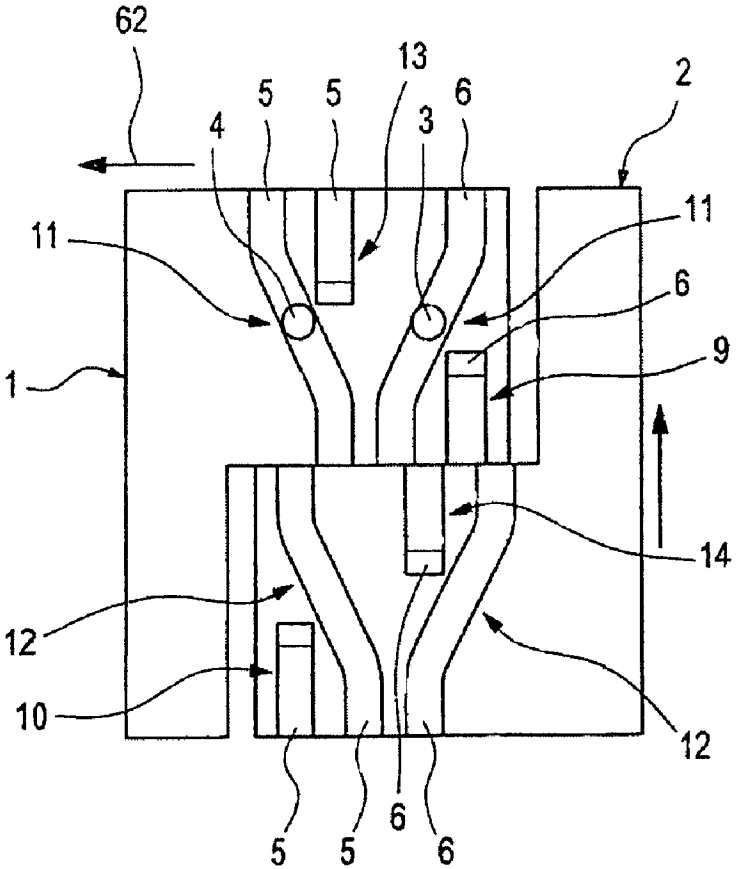
Figure 15B:
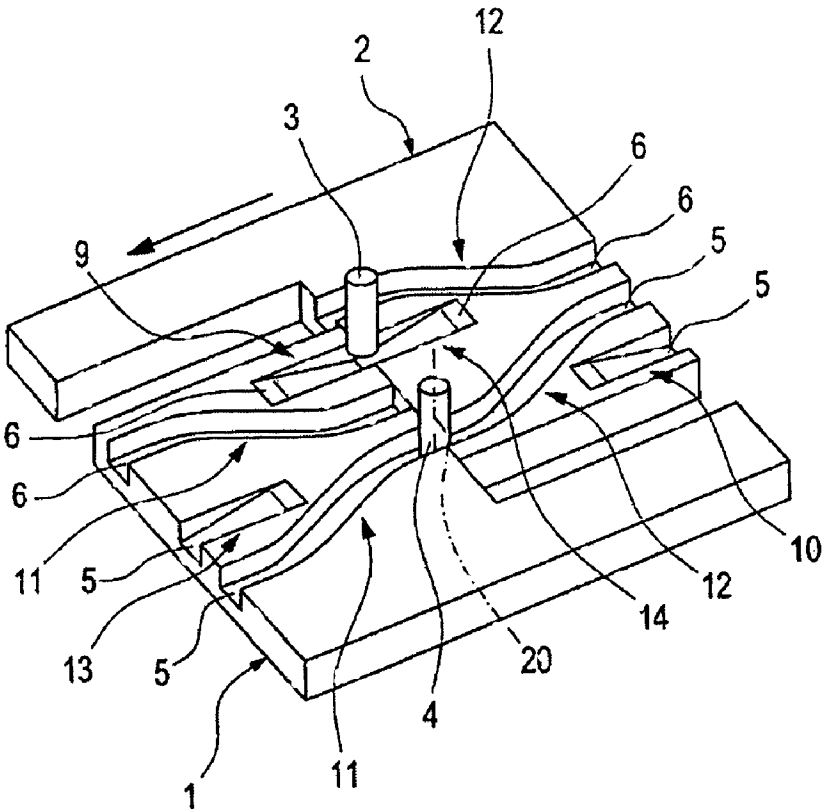
Figure 15A:
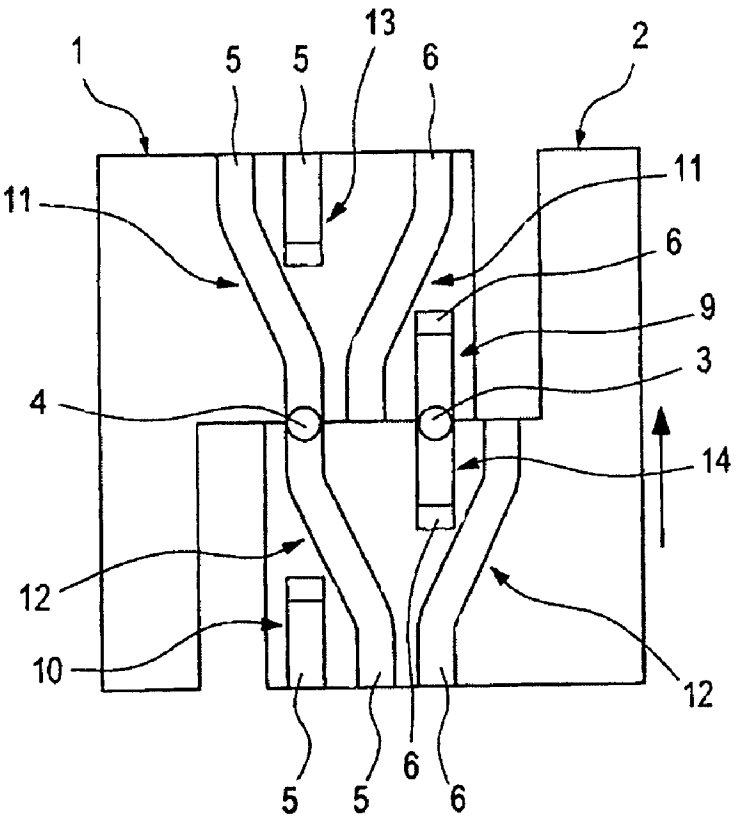
Figure 16B:
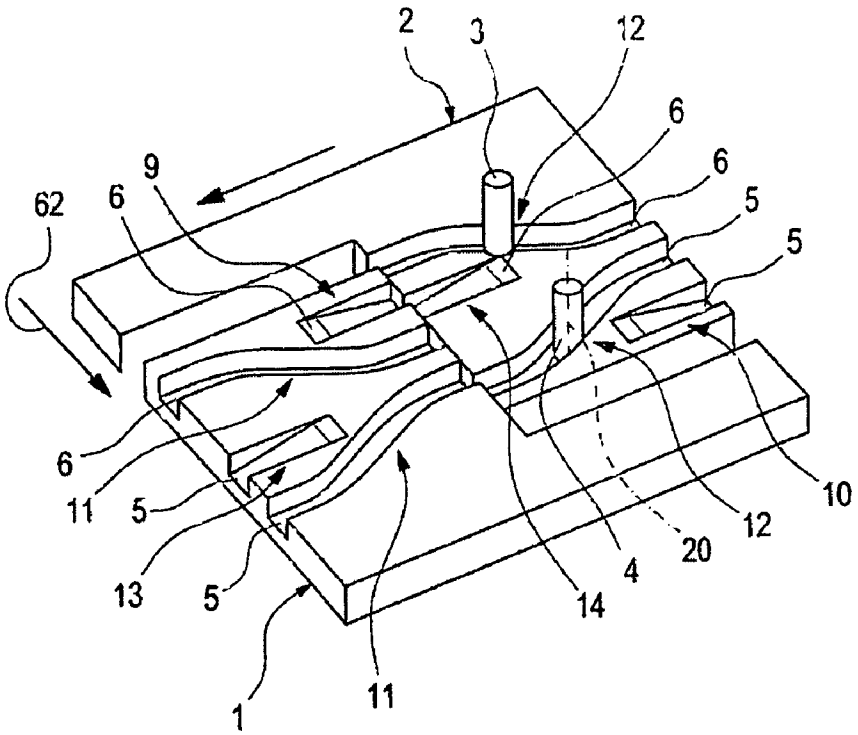
Figure 16A:
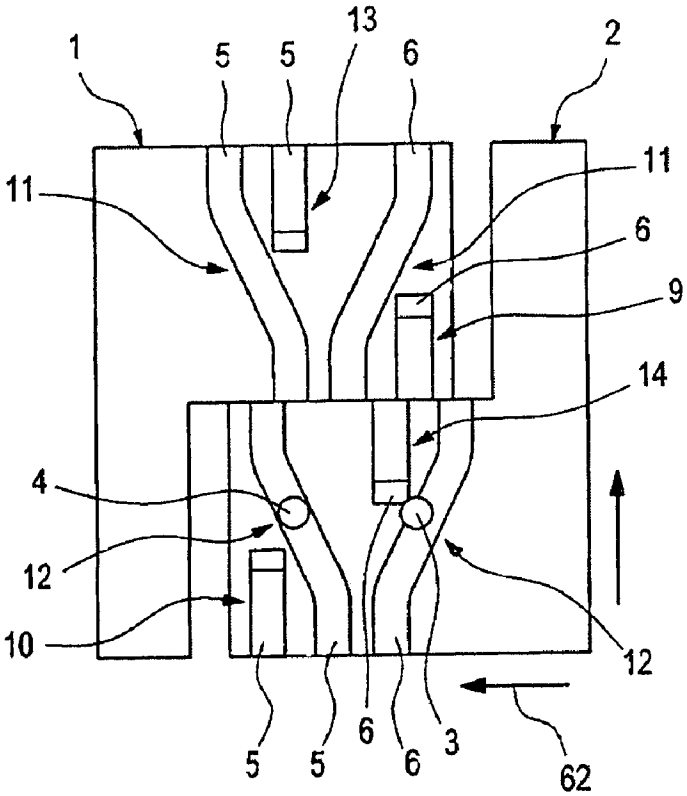
Figure 17B:
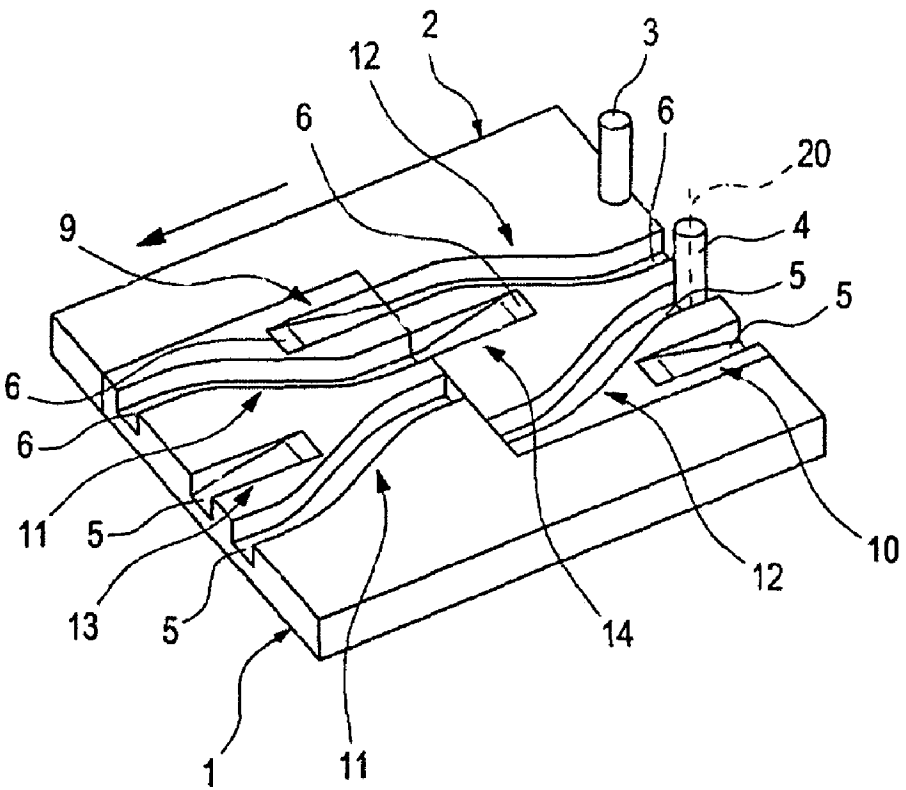
Figure 17A:
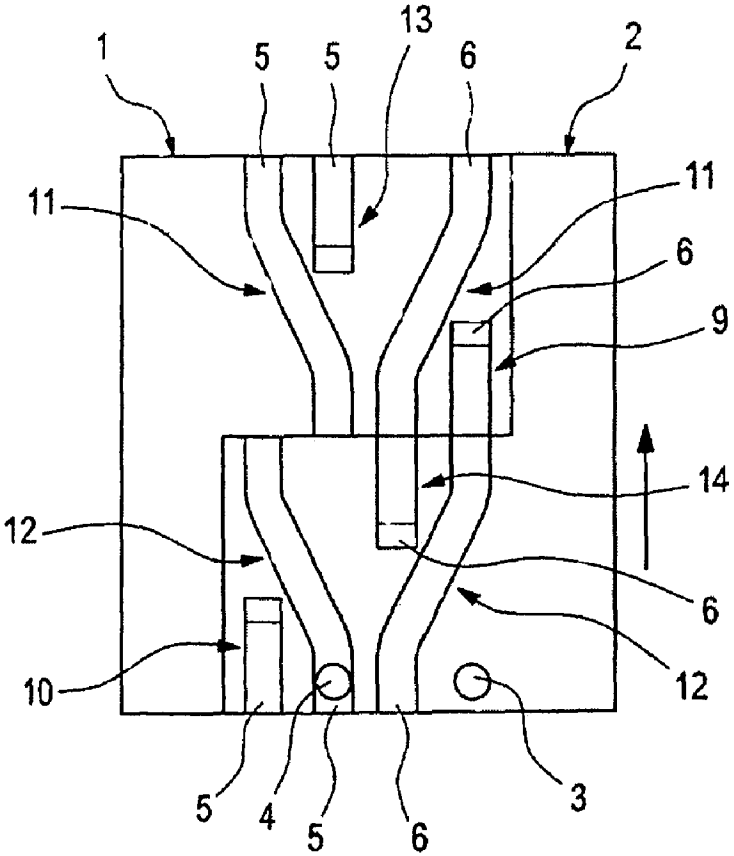
Figure 18B:
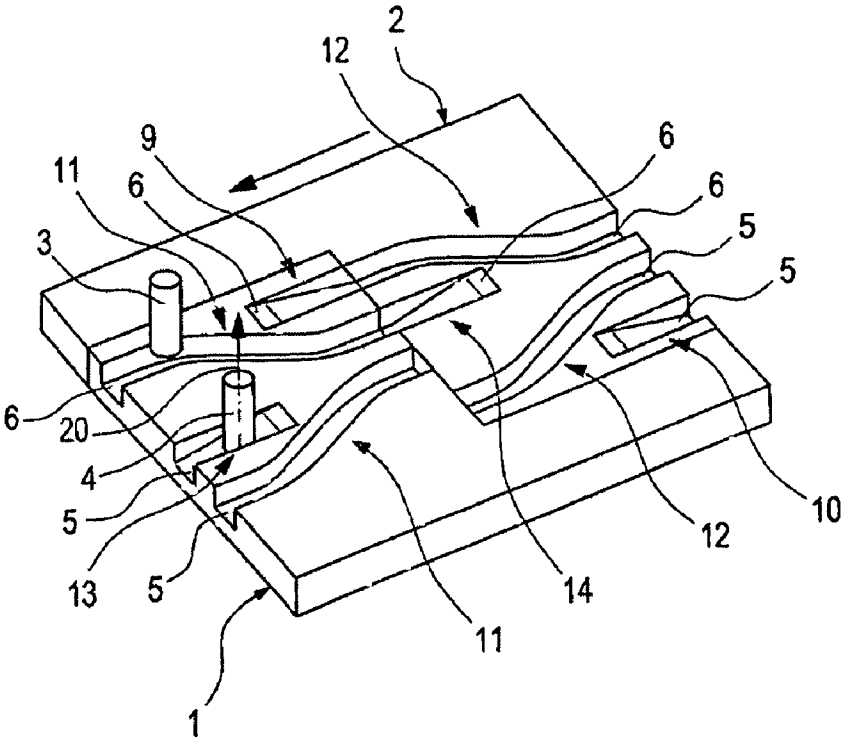
Figure 18A:
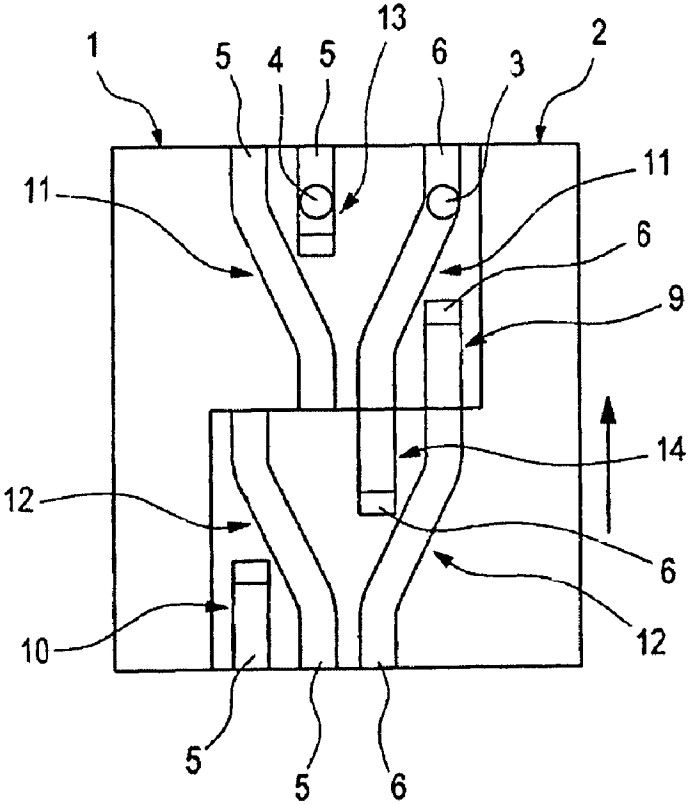
Figure 19B:
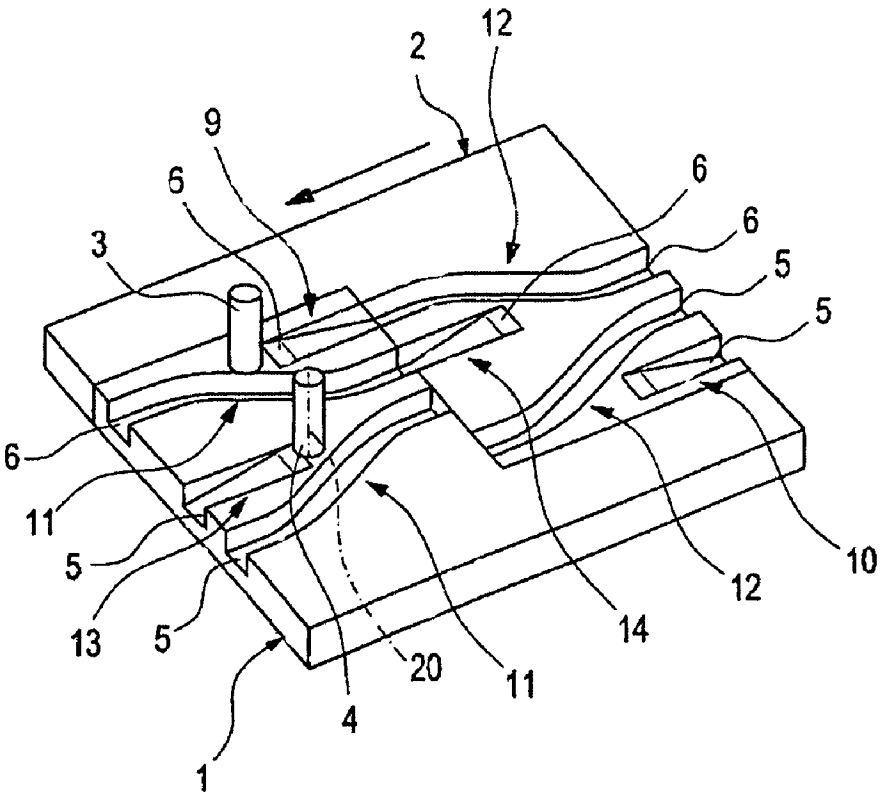
Figure 19A:
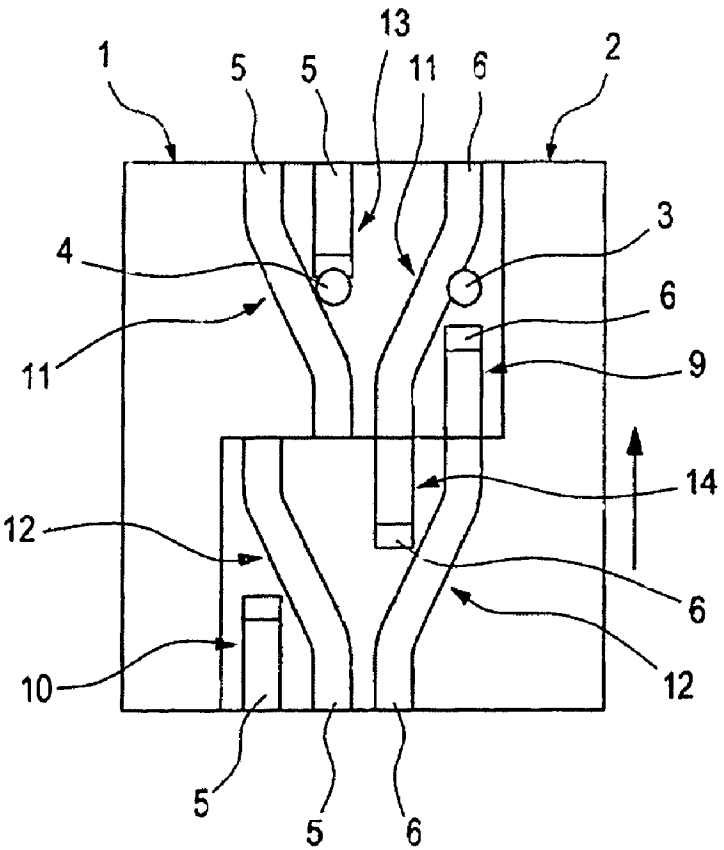

FIG. 3 schematically shows a plan view of the developments of the control tracks 5 and 6, which form a transmission 42, which is formed as a cam transmission. The development of the two control tracks 5, 6 is formed by two L-shaped parts of a development of the switching units 1, 2, which have a rectangular form between two switching processes, in which different switching processes participate. An L-shaped part respectively comprises two halves of the control tracks 5, 6, which belong to different control tracks 5, 6. The control tracks 5, 6 have the sections 9 to 18, which, in interaction with the switching means 3, 4, effect different functions of the switching means 3, 4 and/or of the switching units 1, 2, wherein the different sections 9 to 18 of the control tracks 5, 6 reach an operative connection with the switching means 3, 4 in dependence on the rotary angle of the camshaft 46 (see FIG. 1).

The sections 9 to 18 are plunging sections 9 and 10, actuation sections 11 and 12, push-out sections 13 and 14, change-over sections 15 and 16, and resting sections 17 and 18. The functions are a moving of the switching means 3, 4 into the plunging section 9, 10 of the control track 5 or 6, a removal of the switching means 3, 4 from a push-out section 13, 14 of the control track 5 or 6, an actuation of at least one of the switching units 1 or 2 by displacing the switching unit 1, 2 via the switching means 3, 4 in the actuation section 11, 12, a change-over of the switching means 3, 4 from one of the switching units 1, 2 to another switching unit, and a resting of the switching movement of one of the switching units 1, 2. The switching means 3, 4 reach an operative connection with the sections 9 to 18 in a different sequence in dependence on the rotary direction of the camshaft 46.

FIGS. 4*a*, 4*b* to 11*a*, 11*b* and 12*a*, 12*b* to 19*a*, 19*b* show a switching of valve trains by means of individual intermediate states, which are actuated by the cams 7, 8, 48, 50 of the camshaft 46 (see FIG. 1), by axial displacement of the two switching units 1, 2, wherein the switching process to the right is shown in FIGS. 4*a*, 4*b* to 11*a*, 11*b*, and the switching process to the left is shown in FIGS. 12*a*, 12*b* to 19*a*, 19*b*. During the switching process to the left, the switching units 1, 2 move in such a manner that the ends 56, 58 move relative to the switching means 3, 4 in the direction of the cams 48, 50 in a main extension direction 62 (see FIGS. 16*a* and *b*) of the camshaft 46 (see FIG. 1). During a switching process to the right, the switching units 1, 2 move into a main extension direction 60 opposite thereto (see FIGS. 5*a* and 5*b*). The switching processes to the right and the left respectively consist of two switching processes, in which the individual switching units 1, 2 are moved relative to the switching means 3, 4 in the axial direction.

In the following, the switching process to the right is carried out. In a first step according to FIGS. 4*a* and 4*b*, the right switching means 3 is moved into the plunging section 9 of the control track 6 by the actuator 65 (see FIG. 1) based on a signal given in the form of a magnetic field by the actuator 65. In a second step according to FIGS. 5*a* and 5*b*, the right switching means 3 is in the actuation section 12 of the control track 6 and starts to displace the right switching unit 2 in the main extension direction 60 of the camshaft 46 (see FIG. 1), which is an axial direction. In a third step according to FIGS. 6*a* and 6*b*, the displacement of the right switching unit is slowed down and is then completed. After the displacement of the switching unit 2, which is a position change relative to the switching means 3, 4, the switching means 3 actuates the switching unit 1. In a fourth step according to FIGS. 7*a* and 7*b*, the right switching means is just before the actuation section 11 of the control track 6 of the switching unit 1. In a fifth step according to FIGS. 8*a* and 8*b*, the right switching means 3 is in the actuation section 11 of the control track 6 of the left switching unit 1 and starts its displacement in the main extension direction 60. In a sixth step according to FIGS. 9*a* and 9*b*, the displacement of the left switching unit 1 is completed. In a seventh step according to FIGS. 10*a* and 10*b*, the right switching means 3 is in the push-out section 14 of the control track 6 of the right switching unit 2 and is pushed back into the starting position in the direction of a vertical axis 19, which proceeds in the radial direction relative to the camshaft 46 (see FIG. 1). In an eighth step according to FIGS. 11*a* and 11*b*, the right switching means 3 is again in the starting position. The two switching processes, in which the switching units 1, 2 are displaced to the right relative to the switching means 3, 4, thus proceed in an automated manner, after the actuator 64 or the actuator 65 (see FIG. 1) has issued the signal, with a rotating camshaft 46, that is, without further signals coming from the outside of the actuating unit 38. The same occurs in the switching processes, in which the switching units 1, 2 are displaced successively to the left. Even though an angular speed with which the camshaft 46 rotates, can change during the first half of a switching process to the left or to the right, in which a switching unit 1, 2 is displaced, the second half of the switching process, in which the other switching unit 1, 2 is displaced axially in the same direction, takes place in an automated manner and independently of an electronic measurement of the angular speed.

The switching process to the left is described in the following. In a first step according to FIGS. 12*a* and 12*b*, the left switching means 4 is retracted into the plunging section 10 of the control track 5 by the actuator 64 (see FIG. 1) based on a signal given by the actuator 64. In a second step according to FIGS. 13*a* and 13*b*, the left switching means 4 is just before the start of the actuating section 11 of the control track 5 in the left switching unit 1. In a third step according to FIGS. 14*a* and 14*b*, the left switching means 4 is in the actuating section 11 of the control track 5 of the left switching unit 1 and starts to displace the left switching unit 1 into the main extension direction 62, which is also the axial direction. In a fourth step according to FIGS. 15*a* and 15*b*, the displacement of the left switching unit 1 to the left is completed. In a fifth step according to FIGS. 16*a* and 16*b*, the displacement of the right switching unit 2 starts in the main extension direction 62 to the left. So as to displace the switching units 1, 2 to the left, the switching means 4 thus has to actuate the switching units 1, 2 independently of each other. In a sixth step according to FIGS. 17*a* and 17*b*, the displacement of the right switching unit 2 is slowed down and is then completed. In a seventh step according to FIGS. 18*a* and 18*b*, the left switching means 4 is in the push-out section 13 of the control track 5 of the left switching unit 1 and is pushed back into the starting position in the direction of a vertical axis 20. In an eighth step according to FIGS. 19*a* and 19*b*, the left switching means 4 is again in the starting position. With a change-over of the switching means 4 from one switching unit 1, 2 to another switching unit 1, 2, both switching units 1, 2 are actuated simultaneously in a chronological manner. The analog is valid for the switching process to the right. The switching means 3, 4 correspond to the switching units 1, 2 in all described switching processes.

The two switching units 1, 2 can be actuated by the switching means 3, 4 in a defined switching sequence based on the configuration of the control tracks 5, 6. The switching processes to the left and the right can thus be repeated in principle as often as possible in an arbitrary alternate manner. The switching units 1, 2 are thereby always brought into different switching states by the control tracks for the plunging, actuating, change-over and resting.

The switching units 1, 2 are displaced individually and successively in the same direction to the left or to the right during the switching processes to the left or to the right. The switching units 1, 2 are thus partially decoupled in their movement in the main extension direction of the camshaft 46 (see FIG. 1).

It can be seen by means of the described switching processes, that switching processes to the left are performed by means of the left switching means 4, and switching processes to the right are performed by means of the right switching means 3. A switching direction is respectively associated with each switching means 3, 4.

With the described switching of the valve drive trains, the valve lift curves of valves are changed, which are opened and closed based on the rotation of the camshaft 46 in one operating mode. Valves can further be switched off by the switching and thus remain closed. A change of the operating modi of the internal combustion engine can accompany a change of the valve lift curves.

What is claimed is:

1. An internal combustion engine valve drive train switching device with a switching arrangement (36) including an actuating unit (38) with two switching units (1, 2) and first and second switching means (3, 4) for actuating the switching units (1, 2), the switching units 1, 2 each being provided with valve operating cams of different shapes for actuating valves of the internal combustion engine and being axially movably disposed on a camshaft (46) for rotation therewith, the switching units 1, 2 forming jointly a sleeve but being axially movable also relative to each other and having guide means for engagement by the switching means (3, 4) to be moved sequentially, first one of the switching units (1, 2) for switching the valve operating cams of one cylinder valve and subsequently the other switching unit (1, 2) for switching the valve operating cams of another cylinder valve with a chronological offset.

2. The internal combustion engine valve drive train switching device according to claim 1, wherein the actuating unit (38) is provided to actuate the switching units (1, 2) in at least one operating mode independently of each other in dependence on the positions of the switching units (1, 2) relative to the switching means (3, 4).

3. The internal combustion engine valve drive train switching device according to claim 1, wherein the actuating unit (38) is provided so as to perform a first switching process based on at least one signal, and then a second switching process independently of an electronic evaluation.

4. The internal combustion engine valve drive train switching device according to claim 1, wherein the actuating unit (38) is provided to actuate at least one of the switching units (1, 2) in dependence on a position change of one of the switching units (1, 2) relative to the switching means (3, 4).

5. The internal combustion engine valve drive train switching device according to claim 1, wherein the two switching means (3, 4) of the actuating unit (38) are respectively associated with different switching directions.

6. The internal combustion engine valve drive train switching device according to claim 1, wherein the switching means (3, 4) corresponds to the switching units (1, 2) and the switching units (1, 2) are decoupled at least partially in their movement in such a way that first one of the switching units is moved for switching the cams of a valve of one cylinder and then, subsequently, the other of the switching units is moved for switching the cams of a valve of an adjacent cylinder.

7. The internal combustion engine valve drive train switching device according to claim 1, wherein the actuating unit (38) has at least two control means (52, 54), which are positioned on ends (56, 58) facing each other of the at least two switching units (1, 2) of the actuating unit (38).

8. The internal combustion engine valve drive train switching device according to claim 7, wherein the control means (52, 54) are in the form of at least one control track (5, 6).

9. The internal combustion engine valve drive train switching device according to claim 1, wherein the actuating unit (38) has two one control tracks (5, 6) formed by the switching units (1, 2) and, the control tracks (5, 6) are formed in such a manner that the switching units (1, 2) can be actuated by the switching means (3, 4) in a defined switching sequence.

10. The internal combustion engine valve drive train switching device according to claim 1, wherein the switching unit (1, 2) has at least one control means (52, 54) for changing at least one function of at least one of the switching unit (1, 2) and the switching means (3, 4) based on an interaction with the switching means (3, 4).

11. The internal combustion engine valve drive train switching device according to claim 1, wherein the actuating unit (38) comprises at least one control track (5, 6), which is provided to be acted upon by the switching means (3,4) in a radial direction.

12. A valve drive train switching device for an internal combustion engine according to claim 1, wherein the switching unit (1, 2) and at least one switching means (3, 4) are provided to effect an axial displacement of the switching unit (1, 2) relative to the switching means (3, 4) by an interaction with each other, and thereby provide for a switching of the valve drive train.

13. The valve drive train switching device according to claim 1, wherein the switching unit (1, 2) is in the form of an axially displaceable part of a camshaft (46) which includes cams (7, 8, 26, 27, 28, 29, 30, 31, 48, 50) having at least a partially different contour.

* * * * *